United States Patent [19]

Holz et al.

[11] 4,386,348

[45] May 31, 1983

[54] DISPLAY PANEL HAVING MEMORY

[75] Inventors: George E. Holz, North Plainfield; James A. Ogle, Neshanic Station, both of N.J.

[73] Assignee: Burroughs Corporation, Detroit, Mich.

[21] Appl. No.: 51,313

[22] Filed: Jun. 22, 1979

[51] Int. Cl.[3] ..... G09G 3/28

[52] U.S. Cl. ..... 340/714; 340/769; 340/716; 315/169.1

[58] Field of Search ..... 315/169.1, 169.2, 169.4; 340/713, 714, 716, 768, 769, 794, 773, 775, 779, 798, 792

[56] References Cited

U.S. PATENT DOCUMENTS

| | | | |
|---|---|---|---|
| 2,925,530 | 2/1960 | Engelbart | 313/485 |
| 3,693,046 | 9/1972 | Glaser | 340/775 |
| 3,749,969 | 7/1973 | Miyashiro et al. | 340/769 |
| 3,781,599 | 12/1973 | Bonn | 340/811 |
| 3,812,486 | 5/1974 | Purchase | 340/769 |
| 3,877,006 | 4/1975 | Reboul et al. | 340/776 |
| 3,934,172 | 1/1976 | Okamoto | 340/713 |
| 3,938,133 | 2/1976 | Miller | 340/758 |
| 3,938,135 | 2/1976 | DeJule et al. | 340/769 |
| 3,975,725 | 8/1976 | Ogle | 340/769 |
| 3,989,981 | 11/1976 | Ogle et al. | 340/769 |
| 4,051,409 | 9/1977 | Craycraft | 340/768 |
| 4,079,370 | 3/1978 | Mikoshiba | 340/775 |
| 4,105,930 | 8/1978 | Coleman | 340/714 |
| 4,149,112 | 4/1979 | Miwa et al. | 340/792 |
| 4,171,524 | 10/1979 | Lorteije et al. | 340/713 |

FOREIGN PATENT DOCUMENTS

| | | | |
|---|---|---|---|
| 2442994 | 3/1976 | Fed. Rep. of Germany . | |
| 2642473 | 3/1977 | Fed. Rep. of Germany . | |
| 2545843 | 4/1977 | Fed. Rep. of Germany . | |
| 1554958 | 10/1979 | United Kingdom | 340/769 |

OTHER PUBLICATIONS

Sato et al; *Self-Shift Character Display*, Fujitso Sci. & Technol. J. (Japan), vol. II, No. 2; (6/75).

Slottow, "Plasma Displays", IEEE Transactions on Electron Devices, vol. ED 23-7, Jul. 1976, pp. 760-772.

*Primary Examiner*—Marshall M. Curtis

*Attorney, Agent, or Firm*—Kevin R. Peterson; Robert A. Green

[57] ABSTRACT

The disclosure is of a display panel comprising a gas-filled envelope having a first portion including an array of D.C. gas discharge cells, and a second portion including an array of quasi A.C. gas discharge cells, there being one A.C. cell for each D.C. cell. The A.C. cells are the display cells of the panel and include electrode means for sustaining glow therein, and the D.C. cells are operated in a scanning fashion to address selected A.C. cells in which glow is to be displayed, and they include electrode means for this purpose. The actual operation of addressing or selecting, and firing or turning off, the desired A.C. display cells is achieved by the controlled interaction of the D.C. and A.C. cells; and after the selected display cells have been fired and caused to exhibit visible glow, the glow is sustained, until being erased, by the electrodes associated with the A.C. cells.

38 Claims, 5 Drawing Figures

DISPLAY PANEL HAVING MEMORY

BACKGROUND OF THE INVENTION

Gas-filled display panels have been known for many years; examples of such panels are PANAPLEX panels and SELF-SCAN panels, both of which are made and sold by Burroughs Corporation. These panels are commercially successful, and they operate well, but they do not have memory; that is, a message or character cannot be introduced into these panels by the application of a signal and then retained after that signal has terminated. For a long time, a need has existed for a display panel having the simplicity and reliability of the PANAPLEX and SELF-SCAN panels and also having memory, because of the reliability and high brightness that such a panel would exhibit and the simplicity of its operating circuitry.

One type of prior art panel which has memory is illustrated in U.S. Pat. No. 3,559,190 of Bitzer et al. This panel is an A.C. panel; that is, it employs an A.C. signal applied to electrodes that are insulated from the gas in the panel. The Bitzer et al. panel has a single layer of cells in an internal cellular construction. Because of the isolation afforded by the cellular construction, the individual cells of the panel have a serious first electron problem, and many of the cells are consequently difficult to turn on. A modification of the Bitzer et al. panel is illustrated in U.S. Pat. No. 3,499,167 of Baker et al. as an open construction. While the Baker et al. panel solves the first electron problem, it has a problem with cell definition, and the electronic circuitry it requires is complex and expensive.

Another panel having memory and having considerable potential promise is described in U.S. Pat. No. 3,921,021 of Glaser et al. The present invention is an improvement over the Glaser et al. panel, involving a different mode of operation and a consequent simpler construction and operating circuitry.

SUMMARY OF THE INVENTION

The present invention solves the problems of the prior art by means of a display panel having an array of quasi A.C. display cells and an array of D.C. cells, for D.C. cells being operable to select and address the A.C. display cells, to either establish glow in selective display cells or erase glow selectively from those cells, by means of a controlled interaction between selected A.C. and D.C. cells. Once the glow is established, it is sustained, until it is erased, by the applied A.C. signal.

DESCRIPTION OF THE PREFERRED EMBODIMENTS

The display panel described herein utilizes structual features of SELF-SCAN panels of the type described and claimed in a number of U.S. patents, including Pat. Nos. 3,989,981; 4,035,689; 3,875,474 and 3,821,586, which are incorporated herein by reference. Also incorporated herein by reference are a book entitled ADVANCES IN IMAGE PICKUP AND DISPLAY, Vol. 3, Academic Press, 1977, which describes details of the structure and operation of SELF-SCAN panels, Burroughs Corporation Bulletin No. S101C entitled SINGLE-REGISTER SELF-SCAN PANEL DISPLAY THEORY OF OPERATION, Bulletin No. S104D entitled SELF-SCAN PANEL DISPLAY SUBSYSTEMS THEORY OF OPERATION, and Bulletin No. S102E entitled SELF-SCAN PANEL DISPLAYS TIMING REQUIREMENTS.

Figure 1:
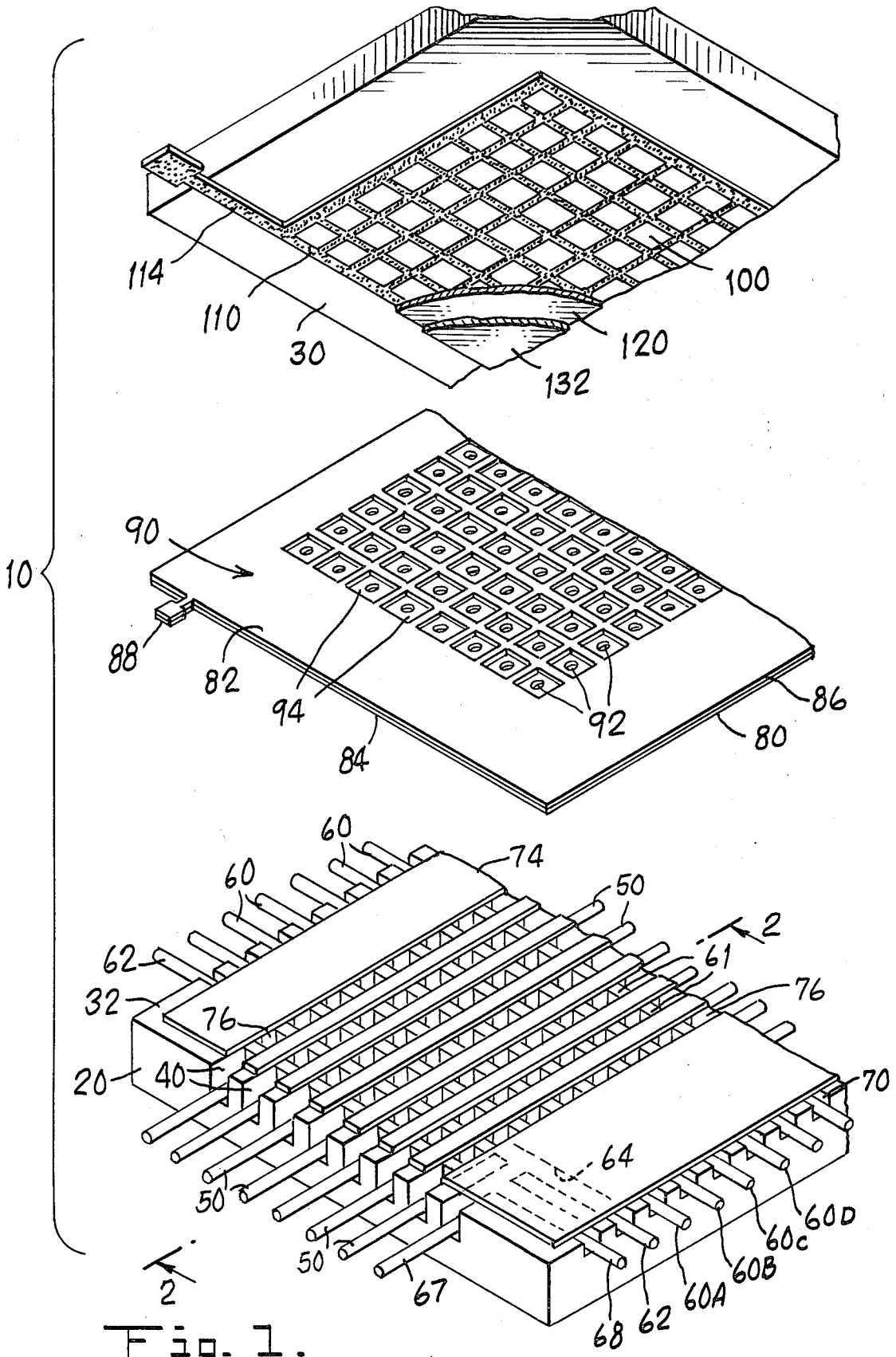
FIG. 1 is a perspective exploded view of a display panel embodying the invention.

A display panel 10 representing one embodiment of the invention includes a gas-filled envelope made of an insulating base plate or substrate 20 and a glass face plate 30, which is shown tilted up in FIG. 1 to present a view of its interior surface. These plates are hermetically sealed together along a closed periphery which surrounds the display cells 94 and the reset and keep-alive cells, leaving a gas-filled space and various electrodes between the plates. The base plate has a top surface 32 in which a plurality of relatively deep parallel slots 40 are formed and in each of which a scan/address anode electrode, for example a wire 50, is seated and secured.

Figure 2:
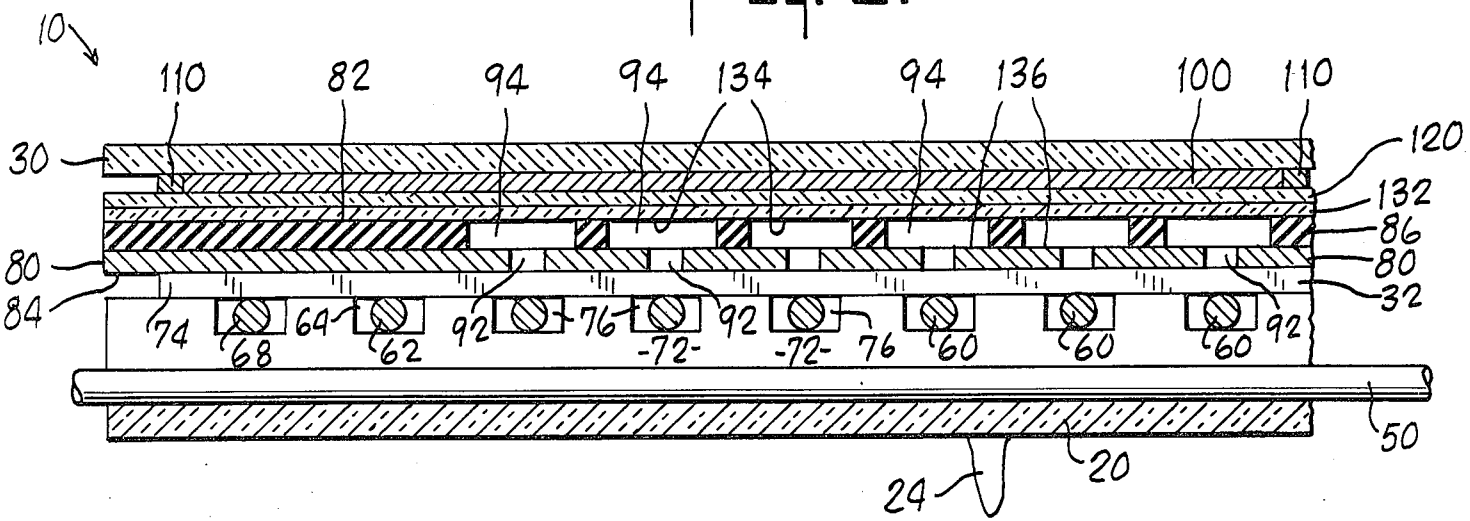
FIG. 2 is a sectional view through the panel of FIG. 1 along lines 2—2, with the panel shown assembled.

A plurality of scan cathode electrodes in the form of wires 60 are seated in relatively shallow slots 70 in the top surface of the base plate. The slots 70 and scan cathodes 60 are disposed transverse to the slots 40 and scan anodes 50, and each crossing of a scan cathode 60 and a scan anode 40 defines a scanning cell 72 (FIG. 2). It can be seen that the scanning cells are arrayed in rows and columns. More specifically, the cathode portions 61, the underlying portions of anodes 50, and the intermediate gaseous regions define the scanning cells.

The scan cathodes 60A, B, C, etc., form a series of cathodes which can be energized serially in a scanning cycle, with cathode 60A being the first cathode energized in the scanning cycle.

A reset cathode strip or wire 62 is disposed in a slot 64 in the top surface of the base plate adjacent to the first scan cathode 60A, so that, when it is energized, it provides excited particles for cathode 60A at the beginning of a scanning cycle to be described. Where the reset cathode crosses each scan anode, a reset cell is formed, and the crossing of all of the scan anodes by the reset cathode provides a column of reset cells. These reset cells are turned on or energized at the beginning of each scanning cycle, and they expedite the turn-on of the first column of scanning cells associated with cathode 60A. In addition, one or more keep-alive cells, as required, are provided in operative relation with the reset cells, such keep-alive cell(s) being made up of an anode 67 and cathode 68 suitably positioned in slots in the base plate in operative relation with each other. Normally, the keep-alive cell is always energized so that a source of first electrons is always present to operate with the reset cells. Keep-alive cells may be dispersed throughout the panel as required.

In the panel 10, it is desirable that the cathodes 60, or at least the portions 61 thereof which are disposed in the scanning cells, be spaced uniformly from an electrode 80 disposed above the cathodes and described below. It is also desirable to provide means for preventing the spread of cathode glow from the operating portions 61 of the cathodes to the intermediate portions. These conditions may be satisfied by providing a thin slotted insulating sheet 74 on the top surface of the base plate 20. The slots 76 in the sheet 74 overlie the portions 61 of the cathodes, and the lower surface of the sheet either touches the intermediate portions of the cathodes or is so close to these portions that cathode glow does not spread along the cathodes from one operating portion 61 to the next. Alternatively, sheet 74 can have a separate aperture for each cathode portion 61, rather than slots, and it can advantageously be formed as a screen printed layer, rather than a sheet.

The portions of the panel described up to this point comprise the base plate assembly. This is the D.C. portion and the scanning and addressing portion of the panel.

Adjacent to the base plate assembly is the second portion of the panel which is a quasi A.C. assembly; that is, it includes A.C. and D.C. features. This portion of the panel includes an electrode in the form of a thin metal plate 80 having an array of rows and columns of relatively small apertures 92, each overlying one of the scanning cells. The plate 80 is positioned close to cathodes 60 and may be seated on insulating sheet or layer 74. Layer 74 may alternatively be formed on the lower surface 84 of plate 80, if desired. Electrode plate 80 includes a contact 88 for making electrical connection thereto.

It is noted at this time that, in the operation of the panel 10, the scan anodes 50 and scan cathodes 60 define a primary current flow path and electrode 80 and the cathodes 60 define a secondary current flow path.

Figure 3:
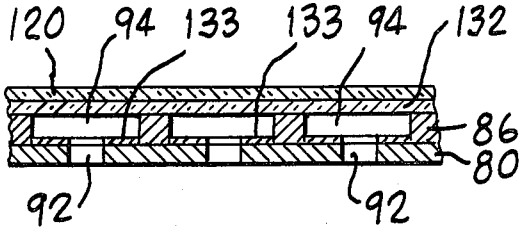
FIG. 3 is an enlarged view of a portion of the panel of FIG. 2, with an added insulating layer 133.

Adjacent to plate 80, and preferably in contact with the upper surface thereof, is an apertured plate or sheet or layer 86 having rows and columns of apertures 94 which are considerably larger than apertures 92. The apertures 94 comprise the display cells of panel 10. The sheet 86 may be of insulating material, as shown in FIG. 2, or it may be of metal, as shown in FIG. 3, and, if it is of metal, the plates 80 and 86 may be made in one piece, if desired and if feasible.

The quasi A.C. assembly also includes a face plate assembly which includes a single large-area transparent conductive electrode 100 on the inner surface of the plate 30 together with a narrow conductor 110 which outlines and reinforces the electrode layer 100 in conductive contact, to increase its conductivity. If desired, the reinforcement conductor 110 may also include a mesh of fine horizontal and vertical conductor portions on electrode 100, with the openings in the mesh being aligned with the display cells 94. The conductor 110 includes a portion 114, to which external connection can be made. The large-area electrode 100 is of sufficient area to overlie the entire array of display cells 94 in plate 86. An insulating coating 120 of glass of the like covers electrode 100.

If the material of insulating coating 120 provides stable electrical operating characteristics and it does not contain materials which adversely affect panel operation, it need not be coated. However, it may be desirable to coat the glass layer 120 with a dielectric layer 132 of magnesium oxide, thorium oxide, or the like.

In panel 10, the apertures 94 in plate 86 comprise display cells, and, as can be seen in FIG. 2, each display cell has one end wall 134 formed by a portion of insulating layer 132, and an opposite end wall 136 formed by a portion of the top surface of plate 80. To provide cell uniformity and to minimize sputtering, a coating of the material of layer 132 should also be provided on the base or lower wall 136 of each display cell 94, such as the layer 133 shown in FIG. 3.

At the present time, it appears that optimum operation of the panel is achieved if the apertures or cells 94 are unsymmetrical in that insulating layers 120 and 132 together have a thickness greater than layer 133. Indeed, layer 133 may even be thinner than layer 132. Thus, the lower end wall 136 of each cell 94 will have a very high capacitance coupling to the cell, and layer 133 will consequently tend to form only a minimal wall charge in the operation described below. In one mode of construction, both layer 132 and layer 133 may be formed by an evaporation process, and layer 133 may be so thin that it is not completely continuous, which is a desirable quality. In any case, however, the character of this wall of the cell is affected by the aperture 92 in the metal plate 80.

The gas filling in panel 10 is perferably a Penning gas mixture of, for example, neon and a small percentage of xenon, at a pressure of about 400 torr. When the panel has been constructed and evacuated, the gas filling is introduced through a tubulation 24 secured to base plate 20 (FIG. 2), or a non-tubulated construction can be employed.

Figure 4:
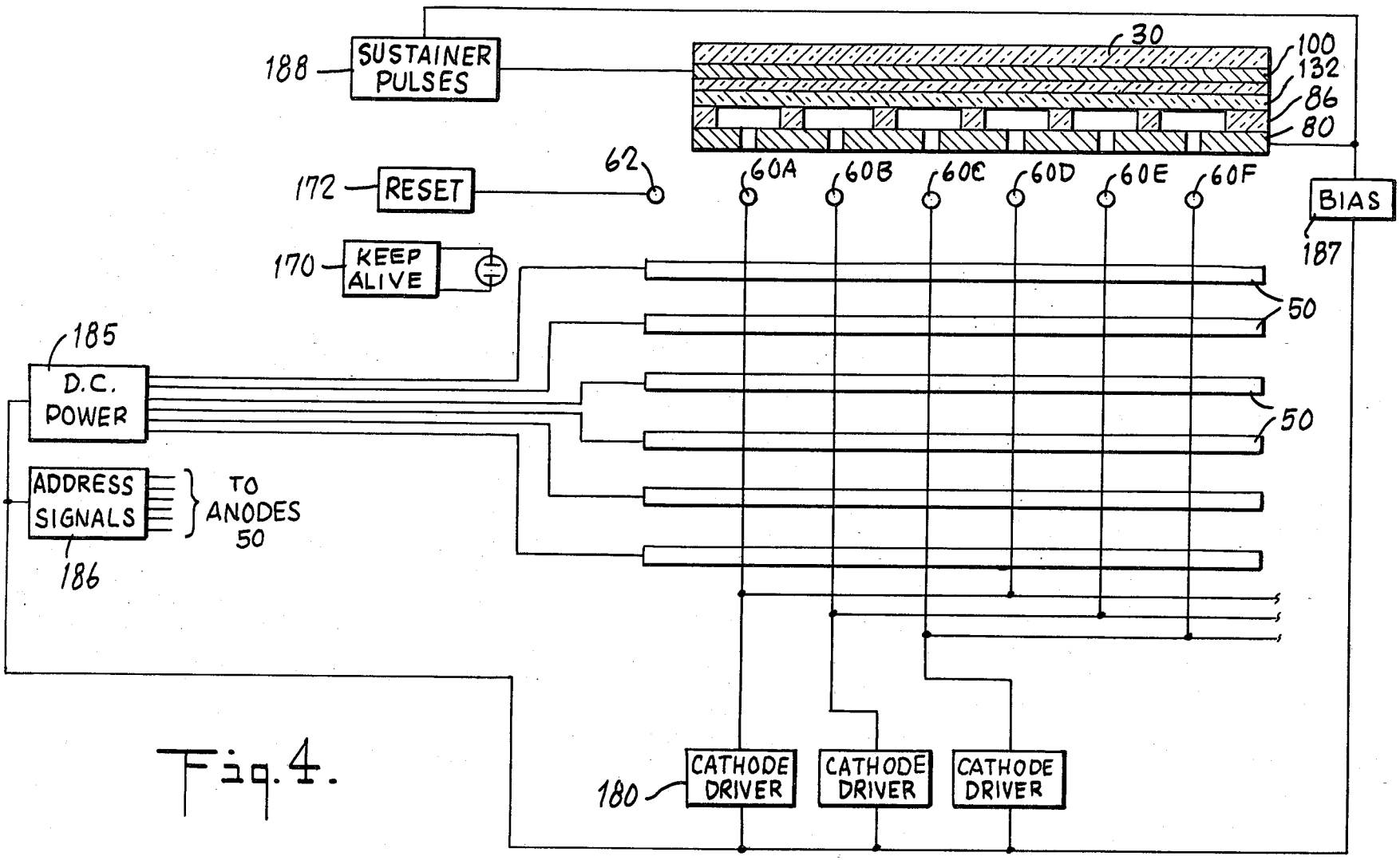
FIG. 4 is a schematic representation of the panel of FIG. 1 and a system in which it may be operated.

A schematic representation of the display panel 10 and a circuit for operating the panel are shown in FIG. 4. The circuit includes a power source 170 for the keep-alive cell 66 and a source 172 of negative reset pulses coupled to reset cathode 62. The cathodes 60 are connected in groups or phases with, for example, every third cathode being connected together in the same group, to form three groups or phases, each group being connected to its own cathode driver 180. Other cathode groupings may also be employed using every fourth or more cathode in each group.

Each of the scan anodes 50 is connected through a suitable resistive path (not shown) to a D.C. power source 185 and to a source 186 of addressing signals to perform write and erase operations. The source of addressing signals 186 may include, or be coupled to, a computer and whatever decoding circuits and the like are required. A source 187 of D.C. bias potential is coupled to plate 80 and a source 188 of alternately positive and negative sustainer pulses is connected to the transparent conductive layer 100.

The system shown in FIG. 4 is not intended to be complete in every detail, in order to keep the drawing as clear and simple as possible. Circuit elements such as diodes, resistors, ground connections, and other components can be readily provided by those skilled in the art and by reference to the publications cited above.

It is well known to those skilled in the art that operating potentials required in gas discharge devices are determined by many factors including the type of gas employed, the gas pressure, electrode sizes and spacings, cell dimensions, etc. The operation of panel 10 will be described in general terms, and typical parameters for one panel which was built and tested will also be provided.

The theory of operation of the panel is not entirely understood at this time, and those who have worked on the panel, or discussed it, do not all agree on all aspects of its mode of operation. However, the general operation of the panel will be described sufficiently to enable one skilled in the art to make and use it.

A brief description of the operation of the panel 10 is that the scanning cells 72 are energized in a column-by-column scan at a selected scan frequency, and sustaining pulses 150 are applied to electrode 100 in synchronism with the column scan—so that as each column of scan cells is being scanned a negative and a positive sustainer pulse are applied to electrode 100.

Under these conditions, if the data signals direct that a particular display cell be turned on, when the column containing the scan cell beneath that display cell is being scanned, the scan cell beneath the selected display cell is momentarily turned off, in synchronism with, and during, the application of a positive sustainer pulse to electrode 100, and it is then turned back on, so that the scanning operation can proceed normally. During the period when this scan cell is turned off, and its discharge is in the process of decaying, electron current flows from its electrode portion 61 to electrode 80, and electrons are drawn through the aperture in electrode 80 into the selected display cell by the positive sustainer pulse. This combination of effects, with some current multiplication probably occurring in the display cell, produces a negative wall charge on wall 134 of the selected display cell, and the combination of the voltage produced by this wall charge and the voltage of the next negative sustainer pulse produces a glow discharge in the selected display cell. This discharge, in turn, produces a positive wall charge on wall 134, which combines with the next positive sustainer pulse to produce a glow discharge, and, in similar manner, successive sustainer pulses produce successive discharges and consequent visible glow in the selected cell.

The erasing operation is similar. In erasing, as in writing, the selected display cell is operated upon while its underlying scan cell is being scanned, but the erase signal is applied in synchronism with, but following, the negative sustainer pulse. For the erase operation, the associated scan cell is again turned off momentarily, and then back on, to avoid interfacing with the normal column-by-column scan of the scan cells. While it is off, the decaying discharge around electrode portion 61 again produces electron flow to electrode 80, and through the aperture in that electrode into the display cell. This serves to remove, or neutralize, the positive charge then on wall 134 of the display cell (which charge was produced by the most recent negative sustainer pulse) so that the next sustainer pulse will fail to produce a glow discharge, and glow in the selected cell will cease.

Figure 5:
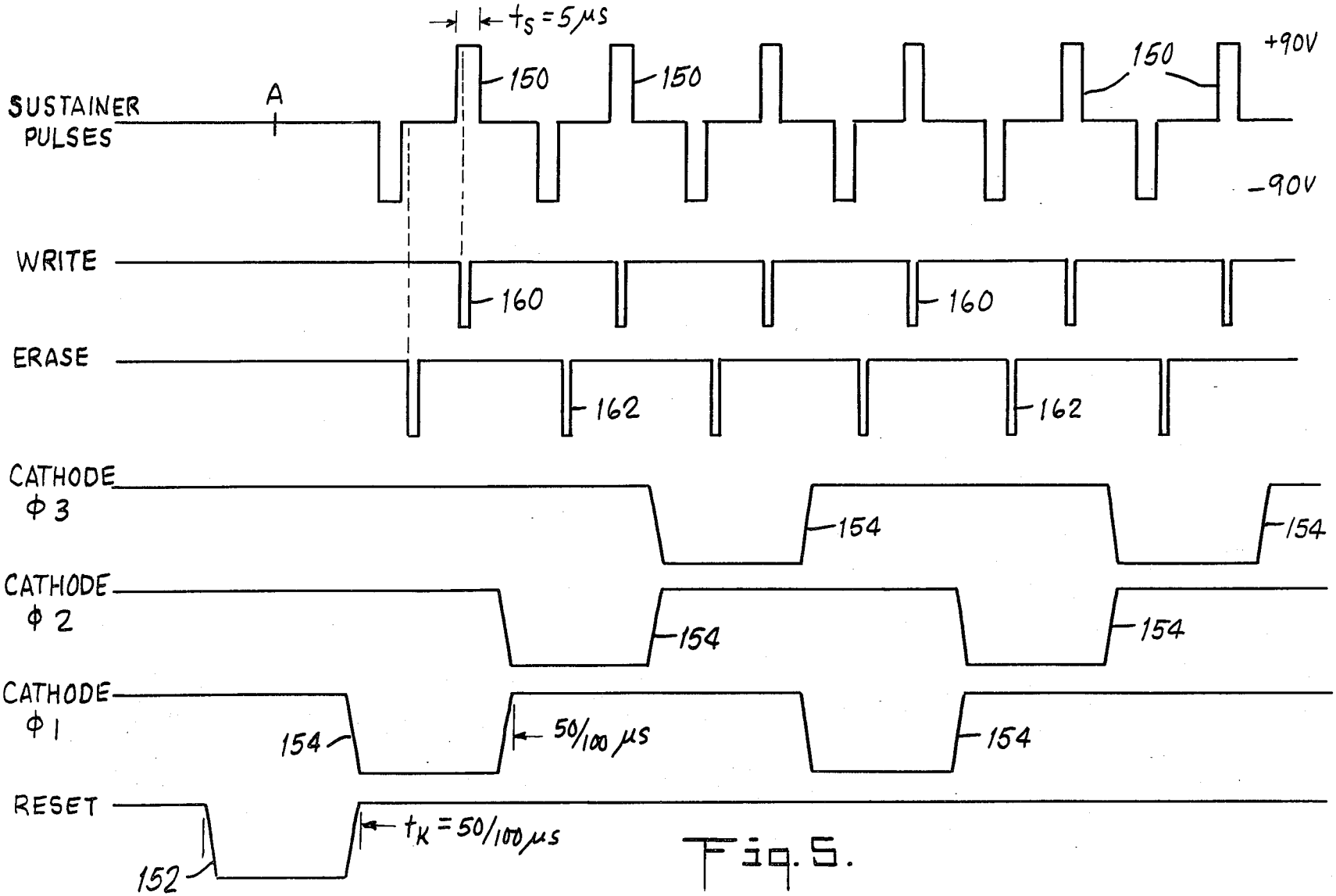
FIG. 5 is a representation of one set of electrical signals which may be used in operating a panel embodying the invention.

As shown in FIG. 5, as each column of scan cells is being energized by a pulse 154, a negative sustainer pulse is applied to electrode 100, and it is followed by a positive sustainer pulse. This is a convenient mode of operating panel 10, which involves erasing each display cell that is "on" in the display cell column corresponding to the scan cell column being energized, and then turning "on" those display cells in the column in which the input data calls for glow. This procedure continues until all of the columns have been scanned, by operating on each display cell column successively to first erase all of the "on" cells of the column and then to turn "on" those cells in the column in which glow is desired.

A more detailed description of the operation of the panel can be made by referring to FIGS. 4 and 5 and considering the D.C. and A.C. portions of the panel separately, and then the overall operation of these two portions.

Referring to FIG. 4, and considering first the base plate assembly, this portion of the panel performs a scanning function in the manner of the scan section of a SELF-SCAN panel of the type described in the patents and publications cited above. In this mode of operation, with the keep-alive cell(s) energized, and the power source 185 connected to the scan anodes, and with the scan cathodes 60 held at a suitable off-bias, first, the reset cathode 62 is energized to provide a column of glowing reset cells adjacent to the first cathode 60A. The column of reset cells is turned on with the aid of excited particles provided by the keep-alive cell(s). Next, the first cathode 60A is energized, from a source 180, and the first column of scan cells associated with cathode 60A is turned on with the aid of excited particles provided by the column of reset cells. By similarly energizing cathodes 60B, 60C, etc., one after another, each column of scan cells, in turn, turns on with the aid of excited particles provided by the preceding column in the scanning cycle.

As is characteristic of a SELF-SCAN panel, the slots 40 in the base plate 20 provide gas communication between the successive columns of scanning cells, so that each such column of cells is in gas communication with the next. Also, even though each cathode driver 180 in FIG. 4 energizes every third scan cathode, only one column of scan cells will exhibit a glow discharge at any time, since only one of the energized cathodes is receiving the aid of excited particles from the next preceding column.

As each cathode wire 60 is energized, in succession, cathode glow is generated between the portions 61 of the selected cathode 60 and the scan anodes 50—and the glow advantageously surrounds portions 61 of the cathode wire. The cathode glow discharge includes excited particles such as ions and electrons, and it also includes metastable atoms.

FIG. 5 shows one set of signals used in operating panel 10. The signals include the reset cathode voltage pulse 152 and the voltage pulses 154 for the three phases or groups of the scan cathodes 60. As shown, the sustainer signals 150 applied to electrode 100 are synchronized with the scan pulses 154 so that both a negative and a positive sustainer pulse are applied within the time that each column of scanning cells is on, which is a period in the range of 20 $\mu$s to 500 $\mu$s, with 50 $\mu$s being commonly used.

Considering the quasi A.C. display portion, the sustainer pulses 150 are applied to the face plate electrode 100, with plate 80 being held at a positive D.C. potential. These pulses do not provide sufficient voltage across the display cells 94 to cause them to fire and glow, and while unfired or "off", these cells have no electrical charge on their walls 134 and 136, and consequently no wall voltage is present.

If a display cell 94 is "on" at time A of the sustainer pulse train in FIG. 5, its wall 134 will have a negative wall voltage. When the next negative sustainer pulse is applied, the sum of the sustainer pulse voltage and the wall charge voltage is sufficient to produce a discharge in the cell, with the wall 134 serving as the cathode. This discharge causes a positive charge build-up on wall 134, which shortly terminates the discharge and leaves an accumulated positive charge on the wall 134. When the following positive sustainer pulse is applied, the sum of the sustainer pulse voltage and the voltage of the wall charge is again sufficient to produce a discharge in the cell, with the wall 134 serving as the anode. This discharge leaves a negative charge on wall 134, which renders the cell susceptible of producing another discharge when the next negative sustainer pulse is applied, and this process of alternately directed glow discharges, and alternate wall charges of opposite polarity, continues with each successive sustainer pulse.

As previously noted, the capacitive coupling of plate 80 to the display cells is so high that, even though layer 133 is present, it assumes no appreciable voltage due to wall charge, and thus charge on wall 136 does not enter into the process. One important advantage of this is that the wall charge on wall 134 is much easier to control by the action occurring in the scan cells, so that selective writing and erasing can be achieved.

With regard to the overall panel operation, the sustainer pulses are applied to A.C. electrode 100, so that this electrode carries alternately positive and negative voltage pulses, and when a write or erase operation is desired, the scanning operation in the D.C. portion of the panel is begun by turning on the column of reset cells, and then successively turning on the columns of scanning cells, beginning with the first column associated with cathode 60A.

If the applied data signals direct that any display cells 94 associated with the first column of scan cells be turned on, as the first column of scan cells is being energized, all of the scan/address anodes 50 receive an erase pulse 162, and, shortly thereafter, the scan/address anodes 50 which lie under the display cells to be turned on receive a write pulse. Both the erase and the write pulses bring the anodes 50 to which they are applied to a voltage which is lower than the sustaining potential for the scan cells, and somewhat lower than the bias potential on the metal plate 80. These pulses, therefore, momentarily interrupt the current flow between the selected scan anodes 50 and their scan cathode 60 and, in effect, momentarily turn off the scan cells defined by these electrodes. When the pulses terminate, however, the scan cells turn on again so that the scanning operation can continue.

During the time that a scan cell is momentarily turned off, by a write or erase pulse, the discharge associated with its cathode begins to decay, and electrons present in the discharge surrounding the energized cathode wire are drawn from the cathode and accelerated toward the metal plate 80. Some of these electrons, as well as other electrons produced by collisions of metastable atoms and other secondary effects, pass through the aperture 92 in the metal plate 80, and into the associated display cell, and come under the influence of the positive accelerating field in the display cell.

In the case of an erase operation, which calls for the application of an erase pulse shortly after the termination of a negative sustainer pulse, for those display cells in the applicable column that are in an "on" condition, their walls 134 bear a positive charge which draws the electrons from the area of cathode 60 to the wall, so as to neutralize or erase this positive wall charge. Thus, the "on" cells in the column are erased. For those display cells of the column that are already off, their walls 134 are uncharged and consequently the erase pulse has no appreciable effect.

In the case of a write operation, which calls for the application of a write pulse while a positive sustainer pulse is being applied, for those display cells that are off, while no wall charge is present, the applied positive sustainer voltage pulse will draw the electrons from the area of cathode 60 to the wall 134, to build up a negative charge on that wall, and render the cell susceptible to being fired by the next negative sustainer pulse, and by successive sustainer pulses thereafter. Thus, the "off" cells to which write pulses are applied are turned "on."

If a display cell is already "on" when a write pulse is applied to its associated scan anode, its wall 134 will already be developing a negative charge during the positive sustainer pulse, and the presence of the electrons from the application of the write pulse will have little effect on the cell.

Thus, both writing and erasing involve the simultaneous occurrence of a termination or extinction of the normal field gradient toward the scan anode, a persistence of a charged particle population in the area proximate the display cell (either in the form of original charged particles from a decaying discharge, or derivative particles from metastable collisions and other secondary effects, or both), and the presence of a positive accelerating field toward the display cell. Also, both writing and erasing involve the concurrent presence of a positive field gradient in the display cells being acted upon, to direct the charged particles toward an insulating wall surface in each cell, which forms the key to the on-off condition of the cell in the presence of the sustainer pulses.

In panel 10 the flow of charged particles is thus effected by a momentary decrease of the voltage on the selected scan anodes, together with the presence of voltage on plate 80 and either an applied positive sustainer pulse or a positive wall charge on wall 134. The flow of electrons thus effected, during either writing or erasing, triggers a positive column glow discharge between the cell wall 134 and the energized scan cathode 60. This results, during writing, in the build-up of a negative charge on the cell wall 134 and a consequent negative wall voltage which will then combine with the voltage of the next negative sustainer pulse to produce a breakdown and glow in the cell, as described above. And during erasing, as already noted, it results in a neutralization of the positive wall charge present on wall 134—and a consequent erasure.

This method of initiating or erasing discharges in selected display cells 94, i.e., of changing the electrical state of the selected cells from "off" to "on" or vice versa, as their associated column of scanning cells is being scanned, is continued as each column of scanning cells is energized sequentially, in keeping with the data signals received, to provide a visible message in the display cells.

While the writing sequence has been described as involving erasing all "on" display cells, and then, during the same column scan period, turning "on" whichever cells are to continue in an "on" condition, other writing sequences can also be used. Thus, one can first apply write signals to those display cells in a column that are to continue in an "on" condition, followed by erase signals to the remaining display cells in the column, during a single column scan period. Such a sequence applied to each column of display cells, one after another, while the corresponding scan columns are being energized, will also result in a full visible display pattern in the display cells.

Similarly, one can perform selective over-writing by selectively writing into or erasing from any selected ones of the display cells in each display cell column, as its corresponding scan cell column is being scanned—and this selective writing and erasing can proceed from column to column of the display cells, as the column scan of the scanning cells progresses, until the column scan has been completed.

Since, as discussed, the write and erase functions occur at different times, one during the positive sustainer pulse and the other following the negative sustainer pulse, writing and erasing can both be performed during the same scan of the scanning cells. Thus, during a single scan, all cells to be turned "on" can be turned "on," and all cells to be turned "off" can be turned "off"—and any single subsequent scan can completely update the display layer as to any changes that are required in the pattern being displayed.

In one panel 10 which has been built and operated satisfactorily, the cathode wires 60 had a diameter of about 3 mils; the apertures 90 in plate 80 had a diameter of about 3 mils and a depth of about 3 mils; the spacing between the cathodes 60 and plate 80 was about 3 mils; the spacing between the cathodes 60 and anodes 50 was about 30 mils; the display cells 94 had a diameter (or width) of about 15 mils and a depth of about 4 mils; and the cells had a spacing of about 20 mils, center to center. The gas filling was 99.8% neon and 0.2% xenon at a pressure of about 400 torr. Layers 120 and 132 together had a thickness in the range of 2 microns to 40 microns (preferably about 20 microns), and layer 133 had a thickness from about 300 angstroms to 30,000 angstroms (preferably 5000 to 6000 angstroms).

For a panel having these mechanical parameters, one set of operable electrical parameters (with all voltages referenced to an "on" scan cathode 60) is as follows.

1. The scan/address anodes 50 are connected through a resistive path to a D.C. power source 185 of about 275 volts, and the anodes are at a sustaining potential of about 175 volts when scanning cells are "on."

2. The scan cathodes carry an off-bias voltage of about 75 to 120 volts and a turn-on voltage of about 0 volts. The turn-on pulses have a duration in the range of 50 μs to 100 μs.

3. The bias voltage on plate 80 is in the range of 75 to 120 volts, but preferably 100 volts.

4. The sustainer pulses 150 have positive and negative symmetrical excursions above and below the bias potential on plate 80 in the range of 70 to 100 volts, with 90 volts being a favorable voltage, and a frequency in the range of 5–30 KHz. Each pulse has a duration of 5 μs and the spacing between pulses is 10 μs.

5. The write and erase pulses 160 and 162 have a negative voltage excursion to about 100 volts with respect to an "on" cathode, and the erase pulse preferably occurs within 10 μs after a negative sustainer pulse.

It will be noted that it is only necessary to operate the lower scanning portion of the panel 10 when it is desired to write or erase information in the panel. Thus, after a message has been written or modified, the scanning operation can be turned off, and then restarted only when a change in the display message is desired.

Since the scan layer need only operate during a small portion of the time that panel 10 is operating, it will exhibit only limited cathode sputtering, and consequent long life in terms of the total operating time of the panel, even if no special precautions, such as the inclusion of mercury vapor, are taken to inhibit cathode sputtering. Thus, for many applications, the use of mercury vapor, as taught in McCauley U.S. Pat. No. 2,991,387, is not required.

Also, while synchronization between the sustaining pulse rate and the scan rate is required during writing and erasing, when no writing or erasing is taking place, the sustaining pulse rate can advantageously be increased or decreased to increase or decrease the brightness of the display.

Further, while synchronization is required during writing and erasing, the sustaining pulse rate can be a multiple of the scan rate, and still be synchronized with the scan rate, in which case multiple positive and negative sustainer pulses will occur during each scan pulse. In such a case, the write pulse must be applied during any one of the positive sustainer pulses, and the erase pulse following any one of the negative sustainer pulses.

The sustainer pulse rate can also be a sub-multiple of the scan rate, and still be synchronized with it. In such a case, multiple scans of the back layer will be required to complete a scan of the display cells. Thus, if the sustainer pulse rate is half the scan rate, one set of sustainer pulses will occur during the time every second column is scanned, and one can write into, or erase from, the cells of those columns. After the scan is completed, a second scan will then permit writing into and erasing from the alternate columns, to effect a complete scan of the display cells. Either an odd number of columns or an effective column period delay will permit writing and erasing in alternate columns during two successive scans. Similarly, other sub-multiples of the scan rate can be used, with a corresponding number of scans of the scanning cells to achieve one scan of the display cells.

It should also be noted that while the write pulse has been described as being applied during the positive sustainer pulse, the time of overlap of these pulses can be very short. Thus, the write pulse can merely straddle the leading or trailing edges of the positive sustainer pulse, and in some instances leading edge straddling has been found to provide an increased margin against cross-talk between adjacent display cells.

Similarly, while the erase pulse has been described as occurring after the negative sustainer pulse, it can straddle the trailing edge of the negative sustainer pulse, and this has also been found to provide an increased margin against cross-talk.

It may be helpful to comment further on the mechanism by which glow is initiated in a display cell. This mechanism has been given the name "supported discharge," and the supported discharge in question takes place from a cathode 60 to plate 80 when the selected scan/address anode is turned off by a write pulse, and the ionization surrounding the associated cathode begins to decay. The supported discharge is believed to occur by reason of the ionization which persists during the decay period, during which time collisions involving metastable atoms generate so-called "daughter" charged particles. A positive column discharge, or positive column-like discharge, from a cathode 60 through the small aperture in plate 80 to wall 134 takes place during this supported discharge period as a consequence of the positive voltage applied to electrode 100.

Thus, during the scanning period, the scan anodes 50 and scan cathode 60 represent the primary operating electrodes, and, even though the metal plate 80 is held at a positive bias potential with respect to the cathodes 60, its potential is such that it does not disturb the scanning operation carried out by the scan cathodes and the scan anodes. However, during the supported discharge period, which occurs when a write pulse is applied, the positive potential on the plate 80 and its close spacing to the cathodes 60, though insufficient to cause glow discharge between it and the cathode 60 during the scanning cycle, does support the discharge which leads to the positive column-like discharge to wall 134, which produces a wall charge in the display cell. Thus, the potential on the plate 80, with respect to the scan anodes and cathodes, and the spacing between the plate 80 and the cathodes 60, as well as the positive potential gradient in the display cells, appear to be important factors in achieving the supported discharge and positive column-like discharge. Moreover, this is equally true for the erase operation.

In addition, the wire shape of the cathodes 60 (being generally circular in cross-section) allows the cathode to be surrounded by electrons and other excited particles, and these particles are therefore positioned close to the metal plate 80. This also facilitates the positive column-like discharge, and the rapid production of glow in a display cell, although other shapes of cathodes which facilitate this operation may be used.

It will be clear to those skilled in the art, in view of the foregoing description of the invention, that modifications may be made in the specific structure described as long as the required mode of operation is achieved. As an example, since the electrode arrangement disposed between the D.C. cells and the quasi A.C. cells is required to attract charged particles such as electrons from the scanning discharge, and to charge the display cell wall, any electrode arrangement which accomplishes this purpose may be employed—so long as the scan function can continue to occur without disturbing the display cells except when write or erase pulses are present. Thus, electrode 80 may not necessarily be a metal plate, since the required function may be obtained by means of one or more insulating plates carrying metalized portions which are suitably shaped and positioned. Also, as already noted, the cathodes 60 need not be wires but may have other configurations so long as the required interrelationship can be achieved between the cathodes and the other electrodes, to provide glow in selected display cells.

It is also clear that the principles of the invention, relating to the selection and addressing of display cells, and the sustaining of display glow in such display cells, may be utilized in display devices other than those described above. In particular, those principles may be applied to devices having a single cell or many cells. Also, a display panel may employ different fields or regions of cells, with each such field being separately addressable, with or without common scanning cathodes. Further, the panel can include fields that are addressable and others that have fixed patterns, to display both fixed and variable data or patterns in the same display medium.

The present invention has many advantages. One advantage is that the display panel provides cell address and memory with a relatively simple panel construction and circuit operation. In addition, since the panel does not require separate electrodes for each display cell, and the display cells are separated only by the thin dividing lines of plate 86, it can achieve high cell density, so that a relatively large number of characters or other patterns can be displayed in the panel. Other advantages will be apparent from the foregoing discussion.

What is claimed is:

1. A display device comprising a first gas cell and an anode electrode and a cathode electrode associated with said first gas cell, said electrodes being operable to have current flow between them for ionizing the gas in said cell and for turning on said first gas cell and providing cathode glow discharge, the cathode glow discharge representing a primary discharge and generating charged particles including electrons which are retained in said first gas cell, a second gas cell for displaying visible glow, said second gas cell being adjacent to said first gas cell with a gas communication path between them, first electrode means for applying sustaining signals to said second gas cell for sustaining visible glow therein once glow has been established, second electrode means between said first gas cell and said second gas cell for attracting charged particles in said primary discharge when such charged particles are not retained in said first cell, whereby said charged particles are drawn into said second cell by said sustaining signals to cause visible glow discharge in said second cell, said visible glow discharge being sustained by said sustaining signals, and means coupled to the electrodes of said first gas cell for turning off said first gas cell and interrupting the current flow between said anode and cathode whereby said charged particles are no longer retained in said first cell and current flows between said cathode and said first and second electrode means and into said second cell which is thereby caused to provide visible glow.

2. The device defined in claim 1 wherein said last-named means momentarily turns off said first gas cell and the charged particles produced in said first cell are attracted to said second cell during that momentary period.

3. The display device defined in claim 1 wherein said second electrode means includes an apertured electrode plate having an aperture between said first cell and said second cell.

4. The device defined in claim 1 wherein said second gas cell includes first and second end walls and an electrode insulated from said first end wall, said sustaining signals comprising alternately positive and negative pulses and said means for applying sustaining signals being connected to said electrode, said charged particles being attracted to said first end wall when said electrode has a positive sustaining pulse applied thereto.

5. The device defined in claim 1 wherein said second gas cell includes first and second end walls, said first cell wall being formed by a layer of insulating material behind which is an electrode to which said means for applying sustaining signals is connected, said second wall being formed by said electrode means, said charged particles being attracted to said first end wall when said electrode has a positive sustaining pulse applied thereto.

6. The device defined in claim 1 wherein said second gas cell has first and second end walls, the second wall being defined by said electrode means and the first wall being defined by an electrode having an insulating layer which insulates the electrode from the gas in the cell, said charged particles being attracted to said first end wall when said electrode has a positive sustaining pulse applied thereto.

7. The device defined in claim 6 and including a layer of insulating material on said second wall.

8. The device defined in claim 7 wherein said insulating layers are of the same material.

9. The device defined in claim 3 wherein said cathode is disposed adjacent to and close to said apertured electrode and said anode electrode is more remote from said apertured electrode so that there is a primary current flow path from said anode to said cathode and a secondary current flow path from said cathode to said apertured electrode.

10. A display device comprising first gas cells and electrode means associated with said first gas cells for scanning and turning on said first gas cells sequentially by generating current flow and glow discharge therein, the glow discharge associated with the electrodes of a first gas cell representing a primary discharge and generating charged particles which are retained in said first gas cells, second gas cells for displaying a message, said second gas cells being spaced from said first gas cells with a gas communication path between a first cell and a second cell, first electrode means for applying sustaining signals to said second gas cells for sustaining glow therein once glow has been established, second electrode means between said first gas cells and said second gas cells for attracting charged particles in said primary discharge, when they are not retained in said first cells and are available, whereby said charged particles are drawn into selected ones of said second cells by said sustaining signals to cause a visible glow discharge in said selected second cells, said visible glow discharge being sustained by said sustaining signals, and means coupled to the electrode means of said first gas cells for momentarily turning off selected ones of said first gas cells and interrupting the current flow therein and thereby not retaining said charged particles in said selected first cells and thus making charged particles available available for said second gas cells.

11. The method of operating a gas-filled display device having scanning means and associated display means, the scanning means comprising rows and columns of gas-filled cells which serve as particle-supply cells, and said display means comprising rows and columns of gas-filled cells, each cell in the scanning means being gas-coupled to a cell in the display means, the method comprising placing the cells of said associated display means in a first electrical state in which they can receive excited particles when such particles are available, operating the scanning means to scan and turn on all of the cells in each group of said cells sequentially, each turned-on cell in a group generating excited particles including electrons which are retained therein, and applying information signals to selected cells in a turned-on group of scanning cells to modify its electrical status, said modification in the electrical status of selected cells in a group of cells serving to discontinue the retention of excited particles therein whereby excited particles flow to the associated cells of said display means to cause said associated cells of said display means to perform a display function.

12. The method of operating a display device including scanning means ans associated display means, said scanning means comprising rows and columns of gas-filled cells which serve as particle-supply cells, each having an anode electrode and a cathode electrode, and associated display means, the display means being gas-filled display cells, each of which is associated with a cell of the scanning means, the method comprising placing said associated display means in a first electrical state in which it can attract excited particles when such particles are available, operating the scanning means to scan and turn on all of the scanning cells in groups, sequentially, each turned-on cell in a group generating excited particles including electrons, which are retained therein, and applying information signals to selected cells in the turned-on group to tend to turn off said selected cells whereby the excited particles associated therewith are not retained therein but are drawn to associated portions of said associated display means whereby the electrical status of said associated portions of said display means is changed and said associated portions can attract excited particles and perform a display function.

13. The method of operating a gas-filled display panel made up of an array of scanning particle-supply cells disposed in rows and columns and an array of display cells disposed in rows and columns, each scanning particle-supply cell being gas-coupled to an associated display cell, said method comprising the steps of scanning and turning on and causing glow discharge in all of said scanning cells sequentially, column by column, said glow discharge generating excited particles including electrons which are retained therein, applying sustainer signals to said display cells without causing glow therein while said first cells are turned on and said excited particles are retained therein, turning off selected cells in each column of scanning particle-supply cells as the column is scanned to release excited particles which serve to simultaneously turn on the associated gas-coupled display cells in the adjacent array and cause them to perform a display operation, and sustaining the glow in the selected display cells by means of said sustainer signals.

14. The method of operating a display device which comprises (1) a first D.C. gas cell including a volume of ionizable gas and anode and cathode electrodes and (2) an A.C. gas cell including a volume of gas and two electrodes, one of which is insulated from the gas, the A.C. gas cell being associated with and in gas communication with the D.C. cell, the A.C. cell comprising a display cell and the D.C. cell comprising a particle-supply cell for the A.C. cell, the method comprising applying alternating sustaining signals across said A.C. cell, said sustaining signals being unable by themselves to cause discharge and visible glow in said A.C. cell when there is no significant wall charge therein, applying firing potentials to the anode and cathode in said D.C. cell to cause glow discharge therein, and to generate excited particles including electrons as a result of the glow, said excited particles being retained in said D.C. cell, and discontinuing the discharge in said D.C. cell whereby excited particles are not retained therein and are drawn into said A.C. cell from said D.C. cell by potentials thereacross due to the sustaining signals, said excited particles producing in said A.C. cell wall charge which combines with the sustaining signals to produce repetitive discharge and visible glow therein.

15. The method of operating a display device which comprises (1) a first D.C. gas cell including a volume of ionizable gas and anode and cathode electrodes and (2) an A.C. gas cell including a volume of gas and two electrodes, one of which is insulated from the gas, the A.C. gas cell being associated with and in gas communication with the D.C. cell, the A.C. cell comprising a display cell and the D.C cell comprising a particle-supply cell for the A.C. cell, the method comprising applying alternating sustaining signals across said A.C. cell, said sustaining signals being unable by themselves to cause discharge and visible glow in said A.C. cell when there is no significant wall charge therein, applying firing potentials to the anode and cathode in said D.C. cell to cause glow discharge and cathode glow therein and to generate excited particles including electrons as a result of the glow, and applying a transfer potential to said D.C. cell, whereby excited particles are not retained therein and are drawn into said A.C. cell from said D.C. cell by the sustaining potential present across said A.C. cell to provide wall charge therein and the wall charge thus provided being utilized by the sustaining signals to produce and sustain glow in said A.C. display cell.

16. The method of operating a display panel comprising a plurality of columns of gas-filled D.C. priming cells, each priming cell including a volume of gas and anode and cathode electrodes, each column of priming cells being in gas communication with the adjacent column, and a plurality of columns of gas-filled A.C. display cells, each display cell including a volume of gas and two electrodes, one of which is insulated from the gas therein, each display cell being associated with and in gas communication with a priming cell, the priming cell comprising a particle-supply cell for the associated A.C. cell, the method comprising the steps of applying alternating sustaining pulses to all of said A.C. display cells, said sustaining pulses, by themselves, being unable to cause discharge and visible glow in said display cells when there is no significant wall charge therein, turning on each column of D.C. priming cells in sequence, beginning with a first column and continuing to the last column to generated excited particles including electrons in each column sequentially, said excited particles being retained in the turned-on cells, and discontinuing the discharge in selected D.C. cells whereby excited particles are not retained in the selected D.C. cells and are drawn into the associated selected A.C. cells from said selected D.C. cells by potentials thereacross due to the sustaining signals, said excited particles producing, in said selected A.C. cells, wall charge which combines with the sustaining signals to produce repetitive discharge and visible glow therein.

17. The method of operating a display panel comprising a plurality of columns of gas-filled D.C. priming cells, each priming cell including a volume of gas and anode and cathode electrodes, each column of priming cells being in gas communication with the adjacent column, and a plurality of columns of gas-filled A.C. display cells, each display cell including a volume of gas and two electrodes, one of which is insulated from the gas therein, each display cell being associated with and in gas communication with a priming cell, the priming cell comprising a particle-supply cell for the associated A.C. cell, the method comprising the steps of applying alternating sustaining pulses to all of said A.C. display cells, said sustaining pulses, by themselves, being unable to cause discharge and visible glow in said display cells when there is no significant wall charge therein.

turning on each column of D.C. priming cells in sequence, beginning with a first column and continuing to the last column to generate excited particles and electrons in each column sequentially, the excited particles being retained in the turned on cells, and applying a transfer potential to selected D.C. priming cells, as the columns of priming cells are turned on, whereby excited particles are released therefrom and are transferred from the selected priming cells into the associated selected display cells to provide wall charge therein, the wall charge thus provided being utilized by the sustaining pulses to produce and sustain visible glow in said selected display cells.

18. A display device comprising a first D.C. gas cell including a volume of ionizable gas and anode and cathode electrodes, an A.C. gas cell including a volume of gas and two electrodes, one of which is insulated from the gas, the A.C. gas cell being associated with and in gas communication with said D.C. cell, the A.C. cell comprising a display cell and the D.C. cell comprising a particle-supply cell for the A.C. cell, means coupled to said A.C. cell for applying alternating sustaining signals across said A.C. cell, said sustaining signals being unable by themselves to cause discharge and visible glow in said A.C. cell when there is no significant wall charge therein, means coupled to said D.C. cell for applying turn-on potential thereto to cause discharge and cathode glow therein and to generate excited particles including charged particles as a result of the glow, said potential retaining said excited particles in said D.C. cell, and other means coupled to said D.C. cell for applying a transfer potential to said D.C. cell, whereby excited particles are not retained in said D.C. cell and are drawn into said A.C. cell from said D.C. cell by the sustaining potential present across said A.C. cell to provide wall charge therein, the wall charge thus provided being utilized by the sustaining signals to produce and sustain glow in said A.C. display cell.

19. A display device comprising a first D.C. gas cell including a volume of ionizable gas and anode and cathode electrodes, an A.C. gas cell including a volume of gas and two electrodes, one of which is insulated from the gas, the A.C. gas cell being associated with and in gas communication with the D.C. cell, the A.C. cell comprising a display cell and the D.C. cell comprising a particle-supply cell for the A.C. cell, means coupled to said A.C. cell for applying alternating sustaining signals across said A.C. cell, said sustaining signals being unable by themselves to cause discharge and visible glow in said A.C. cell when there is no significant wall charge therein, means coupled to said D.C. cell for applying firing potentials to the anode and cathode in said D.C. cell to cause discharge and cathode glow therein and to generate excited particles including charged particles as a result of the glow, said potentials retaining said charged particles in said D.C. cell, and other means coupled to said D.C. cell for discontinuing the discharge in said D.C. cell whereby excited particles are not retained therein and are drawn into said A.C. cell from said D.C. cell by potentials thereacross due to the sustaining signals, said excited particles producing in said A.C. cell wall charge which combines with the sustaining signals to produce repetitive discharge and visible glow therein.

20. A display panel comprising a plurality of columns of gas-filled D.C. priming cells, each priming cell including a volume of gas and anode and cathode electrodes, each column of priming cells being in gas communication with the adjacent column, a plurality of columns of gas-filled A.C. display cells, each display cell including a volume of gas and two electrodes, one of which is insulated from the gas therein, each display cell being associated with and in gas communication with a priming cell, the priming cell comprising a particle-supply cell for the associated A.C. cell, means coupled to said A.C. cells for applying alternating sustaining pulses to all of said A.C. display cells, said sustaining pulses, by themselves, being unable to cause discharge and visible glow in said display cells when there is no significant wall charge therein, means coupled to said D.C. cells for turning on each column of D.C. priming cells in sequence, beginning with a first column and continuing to the last column to generate excited particles including electrons in each column sequentially, said excited particles being retained in said D.C. cells which are turned on, and other means coupled to said D.C. cells for applying a transfer potential to selected D.C. priming cells, as the columns of priming cells are turned on, whereby excited particles are not retained therein and are transferred from the selected priming cells into the associated selected display cells to provide wall charge therein, the wall charge thus provided being utilized by the sustaining pulses to produce and sustain visible glow in said selected display cells.

21. The display panel defined in claim 20 wherein one of the two electrodes of said A.C. display cells is an A.C. electrode which is insulated from the gas by an insulating layer which forms a wall in each cell and the other of which is an apertured electrode which is disposed adjacent to the D.C. cells, each A.C. cell being associated with and in gas communication with a D.C. cell through an aperture in said apertured electrode.

22. The method of operating a gas-filled display device having scanning means and associated display means, the scanning means comprising rows and columns of gas-filled scanning cells, and said display means comprising rows and columns of display cells, each display cell being associated with a scanning cell, the method comprising placing said display cells in an electrical state such that they can receive excited particles and produce glow when such particles are available, operating the scanning means to scan and turn on all of the cells in each group of said cells sequentially, each turned-on cell in a group generating excited particles, and applying information signals to selected cells in a turned-on group of scanning cells to modify its electrical status, said modification in the electrical status of selected cells in a group of cells releasing excited particles to the associated cells of said display means which attract said excited particles and use them to perform a display function.

23. The device defined in claim 8 wherein said insulating layers are of different thicknesses.

24. The device defined in claim 9 wherein the insulating layer on said second wall is thinner than the insulating layer of said first wall whereby the insulating layer on said second wall has a larger electrical capacitance than the insulating layer of said first wall.

25. A display panel comprising a source of charged particles including electrode means for (1) causing current flow and the generation of charged particles and the retention of said charged particles in said source, and (2) discontinuing the current flow and the generation of charged particles and the retention of said charged particles in said source, and display means including electrode means for attracting charged particles, when such particles are not retained in said source, and producing wall charge with said charged particles, said electrode means of said display means including means for placing said display means in an electrical state in which it cannot attract charged particles to produce wall charge while said electrode means of said source is generating charged particles and retaining them in said source but it can attract charged particles when said electrode means of said source discontinues the generation of charged particles and as a result said charged particles are not retained in said source.

26. A display panel comprising a first cell including electrodes and means for initiating electrical current flow between said electrodes and retaining said current flow in said first cell, said means of said first cell also being operable for discontinuing electrical current flow between said electrodes, thus discontinuing the retention of said current flow in said first cell, and a second cell including electrode means for drawing current from said first cell and utilizing said current, said electrode means of said second cell including means for placing it in an electrical state in which it cannot draw current from said first cell while current is flowing in said first cell and is retained therein, but it can draw current when said means discontinues the current flow in said first cell and said current is no longer retained in said first cell.

27. A display panel comprising a gas-filled envelope including a first cell comprising a source of excited particles including electrode means (1) for causing the generation of charged particles and the retention of said charged particles in said first cell, and (2) for discontinuing the generation of charged particles, thus discontinuing the retention of said excited particles in said first cell, and a second cell including electrode means for attracting charged particles, when such particles are not retained in said first cell and are available to it, and drawing a positive column to said second cell and producing wall charge therein, said electrode means of said second cell including means for placing said second cell in an electrical state in which it cannot attract charged particles to draw a positive column and produce wall charge while said electrode means of said first cell is generating charged particles and retaining them in said first cell but it can attract charged particles and draw a positive column when said electrode means of said first cell discontinues the generation of charged particles and the retention of said charged particles in said first cell.

28. The panel defined in claim 27 wherein said second cell comprises a gas-filled display cell.

29. A display panel comprising a source of excited particles including electrons, said source including an anode and a cathode for generating electrical current flow which produces cathode glow and said excited particles, said anode and cathode retaining said current flow in said source, said anode and cathode also being operable to discontinue the current flow and the generation of excited particles and to discontinue the retention of said current flow in said source, and a display cell including electrode means for attracting excited particles to said display cell when such particles are available to it and producing wall charge with said excited particles and then using the wall charge to produce glow discharge, said electrode means of said display cell including means for placing it in such an electrical state that it cannot attract excited particles to produce wall charge and glow discharge while said anode and cathode of said source are generating current flow and excited particles and are retaining said current flow in said source, but it can attract excited particles and cause glow discharge when said anode and cathode of said source discontinue the current flow and the generation of excited particles and discontinue the retention of said current flow in said source.

30. A display panel comprising a source of excited particles including electrons, said source including an anode and a cathode for generating electrical current flow which produces cathode glow and said excited particles, said excited particles being held close to said cathode, said anode and cathode also being operable to discontinue the current flow and the generation of excited particles, and a display cell including electrode means for attracting excited particles to said display cell when such particles are available to it and producing wall charge with said excited particles and then using the wall charge to produce glow discharge, said cathode being disposed adjacent to said display cell, said electrode means of said display cell including means for placing it in such an electrical state that it cannot attract excited particles to produce wall charge and glow discharge while said electrode means of said source is generating electrical current and excited particles which are retained close to said cathode but it can attract excited particles and cause glow discharge when said electrode means of said source causes the discontinuance of the generation of excited particles and said excited particles are not held close to said cathode.

31. A display panel comprising a source of excited particles including electrons, said source including an anode and a cathode for generating electrical current flow which produces cathode glow and said excited particles, said excited particles being held close to said cathode, said anode and cathode also being operable to discontinue the current flow and the retention of excited particles close to said cathode, and a display cell including electrode means, including an A.C. electrode and an apertured electrode, for attracting excited particles to said display cell when such particles are available to it and producing wall charge adjacent to said A.C. electrode with said excited particles and then using the wall charge to produce glow discharge, said electrode means of said display cell including means for placing it in such an electrical state that it cannot attract excited particles to produce wall charge and glow discharge while said anode and cathode of said source are generating current flow and excited particles which are retained close to said cathode but it can attract excited particles and cause glow discharge when said anode and cathode of said source discontinue the current flow and the generation of excited particles and said excited particles are not held close to said cathode.

32. A display panel comprising a source of excited particles including electrons, said source including an anode and a cathode for generating electrical current flow which produces cathode glow and said excited particles, said excited particles being held close to said cathode, said anode and cathode also being operable to discontinue the generation of excited particles, and a display cell including electrode means, including an A.C. electrode and an apertured electrode, for attracting excited particles to said display cell when such particles are available to it and producing wall charge with said excited particles and then using the wall charge to produce glow discharge, said cathode being disposed adjacent to said display cell and to said apertured electrode, said electrode means of said display cell including means for placing it in such an electrical state that it cannot attract excited particles to produce wall charge and glow discharge while said anode and cathode of said source are generating current flow and excited particles but it can attract excited particles and cause glow discharge when said anode and cathode of said source discontinue the current flow and the generation of excited particles and said excited particles are not held close to said cathode.

33. A display panel comprising a gas-filled envelope containing a source of excited particles including charged particles and a display cell, said source including an anode and a cathode for generating electrical current flow which produces cathode glow and said excited particles, said excited particles being held close to said cathode, said anode and cathode also being operable to discontinue the current flow and the generation of excited particles, and said display cell including electrode means for attracting excited particles to said display cell when such particles are available to it and producing wall charge with said excited particles and then using the wall charge to produce glow discharge, said electrode means of said display cell including means for placing it in such an electrical state that it cannot attract excited particles to produce wall charge and glow discharge while said anode and cathode of said source are generating current flow and excited particles but it can attract excited particles and cause glow discharge when said anode and cathode of said source discontinue the current flow and the generation of excited particles and said excited particles are not held close to said cathode.

34. A display panel comprising a gas-filled envelope containing:

an array of first cells operable as sources of excited particles including charged particles, said first cells being disposed in rows and columns, a row anode in operative relation with each row of cells and a column cathode in operative relation with each column of cells, said anodes and cathodes being operable for turning on said first cells and generating electrical current flow therein which produces cathode glow and said excited particles, said excited particles being retained within first cells which are turned on, said anodes and cathodes also being operable to discontinue the current flow and the generation of excited particles and the retention of excited particles in said first cells, an array of display cells disposed in rows and columns and electrode means for attracting excited particles to said display cells when such particles are available to it and producing wall charge with said excited particles and then using the wall charge to produce glow discharge, said electrode means of said display cells including means for placing said display cells in such an electrical state that they cannot attract excited particles to produce wall charge and glow discharge while said anodes and cathodes of said first cells are generating current flow and excited particles but said display cells can attract excited particles and cause glow discharge when said anodes and cathodes of said first cells discontinue the current flow and the generation of excited particles and the excited particles are not retained in said first cells.

35. A display panel comprising a gas-filled envelope containing;

an array of first cells operable as sources of excited particles including electrons, said first cells being disposed in rows and columns, a row anode in operative relation with each row of cells and a column cathode in operative relation with each column of cells, said anodes and cathodes being operable for generating electrical current flow which produces cathode glow and said excited particles which are retained in said first cells, said anodes and cathodes also being operable to discontinue the current flow and the retention of excited particles in said first cells, and an array of display cells disposed in rows and columns and having electrode means for attracting excited particles to said display cells when such particles are available to it and producing wall charge with said excited particles and then using the wall charge to produce glow discharge, said electrode means comprising a large-area transparent conductor and an apertured electrode spaced therefrom, said apertured electrode being positioned adjacent to said column cathode electrodes and having an aperture for each first cell, said electrode means of said display cells including means for placing said display cells in such an electrical state that they cannot attract excited particles to produce wall charge and glow discharge while said electrode means of said first cells is generating current flow and excited particles which are retained therein but they can attract excited particles and cause glow discharge when said electrode means of said first cells discontinues the current flow and the retention of excited particles in said first cells.

36. A display device comprising a first gas cell having an anode electrode and a cathode electrode, said anode and cathode electrodes being adapted to have electrical potential applied between them to cause current flow between them, said current flow serving to ionize the gas in said first cell adjacent to said cathode electrode and thereby serving to turn on said first gas cell and to generate cathode glow discharge, the cathode glow discharge representing a primary discharge and generating excited particles including electrons and other particles which are retained in said first cell, a second gas cell for displaying visible glow, said second gas cell being adjacent to said first gas cell with a gas communication path between them, said gas communication path including a constricted portion, and electrode means associated with said second gas cell including means for applying sustaining signals to said second gas cell for sustaining visible glow therein once glow has been established therein, said means being adapted, when said current flow in said first cell is interrupted and excited particles are not retained therein, to draw some of said excited particles into said second cell to provide wall charge therein and visible glow discharge which is sustained by said sustaining signals, said anode and cathode of said first gas cell also adapted to have said electrical potential altered for, in effect, momentarily turning off said first gas cell and tending to interrupt the current flow between said anode and cathode whereby some of said excited particles can flow into said second cell to produce visible glow therein.

37. A display panel comprising an envelope made up of an insulating base plate and a glass face plate hermetically sealed together, said insulating base plate carrying an array of row anodes and an array of column cathodes, said anodes and cathodes defining an array of rows and columns of first gas discharge cells, said anode and cathode electrodes being adapted to have electrical potential applied between them, column-by-column, to cause current flow between them in each of said columns of first cells sequentially, said current flow serving to ionize the gas in the column of first cells and to generate cathode glow discharge, the cathode glow discharge generating excited particles including electrons and other charged particles, said excited particles being retained in said first cells while current flows therein, and an apertured electrode disposed adjacent to said array of first cells and having an array of apertures disposed in rows and columns, there being at least one aperture associated with each one of said first cells, each of said apertures including a small-diameter portion disposed adjacent to said array of first cells and a larger portion disposed away from said first cells, each larger portion of each aperture comprising a display cell, said face plate carrying on its inner surface, inside said envelope, a large-area transparent electrode coated with a layer of glass to make it an A.C. electrode, said apertured electrode and its array of display cells being disposed adjacent to said glass layer on said face plate, said large-area electrode and said apertured electrode comprising electrode means for applying sustaining signals to said display cells for sustaining visible glow therein once glow has been established therein, said electrode means being adapted, when current flow in selected first cells is interrupted, to draw excited particles into the associated display cells to provide wall charge therein and visible glow discharge which is sustained by said sustaining signals, said anode and cathode electrodes of said first gas cells also being adapted to have said electrical potential altered for interrupting the current flow therein.

38. A display panel comprising an envelope made up of a base plate and a glass face plate hermetically sealed together, said base plate having a top surface and an array of parallel slots in said top surface, an anode electrode seated in each of said parallel slots, an array of parallel cathode electrodes on the top surface of said base plate, said cathode electrodes being disposed transverse to said anodes so that each cathode crosses each anode and each crossing of an anode and a cathode forms a first gas discharge cell, all of the electrode crossings forming rows and columns of first gas discharge cells, said anode and cathode electrodes of said first cells being adapted to have electrical potential applied between them, column-by-column, to cause current flow between them in each of said columns of first cells sequentially, said current flow serving to ionize the gas in the columns of first cells and to generate cathode glow discharge, the cathode glow discharge generating excited particles including electrons and other charged particles, said excited particles being retained in said first cells while said electrical potential is applied and current flows therein, and an apertured electrode disposed adjacent to said array of first cells and having an array of apertures disposed in rows and columns, there being at least one aperture associated with each one of said first cells, each of said apertures including a small-diameter portion disposed adjacent to said array of first cells and a larger portion disposed away from said first cells, each larger portion of each aperture comprising a display cell, said face plate carrying on its inner surface, inside said envelope, a large-area transparent electrode coated with a layer of glass to make it an A.C. electrode, said apertured electrode and its array of display cells being disposed adjacent to said glass layer on said face plate, said large-area electrode and said apertured electrode comprising electrode means for applying sustaining signals to said display cells for sustaining visible glow therein once glow has been established therein, said electrode means being adapted, when said current flow in selected first cells is interrupted, to draw excited particles into the associated display cells to provide wall charge therein and visible glow discharge which is sustained by said sustaining signals, said anode and cathode electrodes of said first gas cells also being adapted to have said electrical potential altered for interrupting the current flow therein.

* * * * *